US006792626B1

(12) United States Patent
Smeal et al.

(10) Patent No.: US 6,792,626 B1
(45) Date of Patent: Sep. 21, 2004

(54) APPARATUS FOR LOWERING TOILET SEAT

(76) Inventors: Bryan Smeal, P.O. Box 1454, Levittown, PA (US) 19058; Chris Summers, P.O. Box 1454, Levittown, PA (US) 19058

( * ) Notice: Subject to any disclaimer, the term of this patent is extended or adjusted under 35 U.S.C. 154(b) by 15 days.

(21) Appl. No.: 10/175,376

(22) Filed: Jun. 18, 2002

Related U.S. Application Data

(60) Provisional application No. 60/298,642, filed on Jun. 18, 2001.

(51) Int. Cl.[7] ..... A47K 13/10
(52) U.S. Cl. ..... 4/246.1
(58) Field of Search ..... 4/246.1, 246.2, 4/246.3, 246.4

(56) References Cited

U.S. PATENT DOCUMENTS 5,060,318 A 10/1991 Jaskiewicz
5,307,524 A * 5/1994 Veal ..... 4/246.1
5,488,744 A 2/1996 Paananen
5,603,127 A * 2/1997 Veal ..... 4/246.1
5,794,277 A 8/1998 Jones
5,878,444 A * 3/1999 Convoy ..... 4/246.1
6,067,667 A * 5/2000 Suzuki ..... 4/246.1
6,226,804 B1 * 5/2001 Ballard ..... 4/246.1
6,321,393 B1 * 11/2001 Jones ..... 4/246.1

* cited by examiner

*Primary Examiner*—Gregory Huson
*Assistant Examiner*—Huyen Le
(74) *Attorney, Agent, or Firm*—Matthew J. Peirce

(57) ABSTRACT

An apparatus for automatically lowering a toilet seat is disclosed. The apparatus includes a sensor which senses when a person has finished using a toilet, at which time, the sensor activates a motor to lower the toilet seat in a slow but steady manner. The motor is powered by power means, which could be either a battery or standard household current. Alternatively, the present invention would include a relay which would be mechanically connected to the flush handle of the toilet. When the flush handle would be used, the relay would activate the motor to lower the toilet seat in a slow but steady manner.

3 Claims, 2 Drawing Sheets

FIG 1
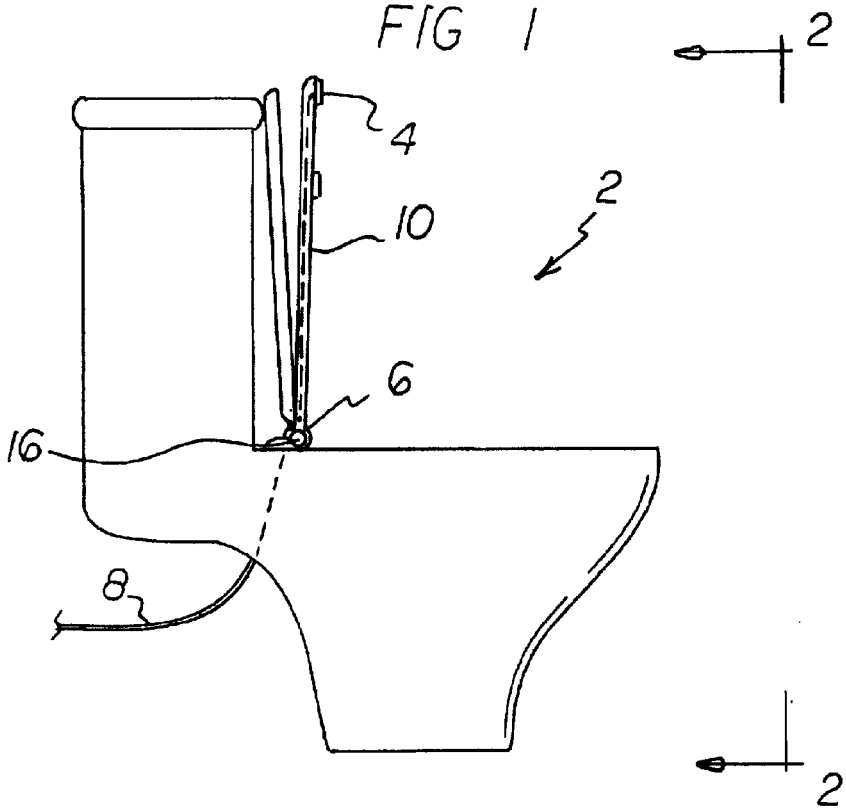
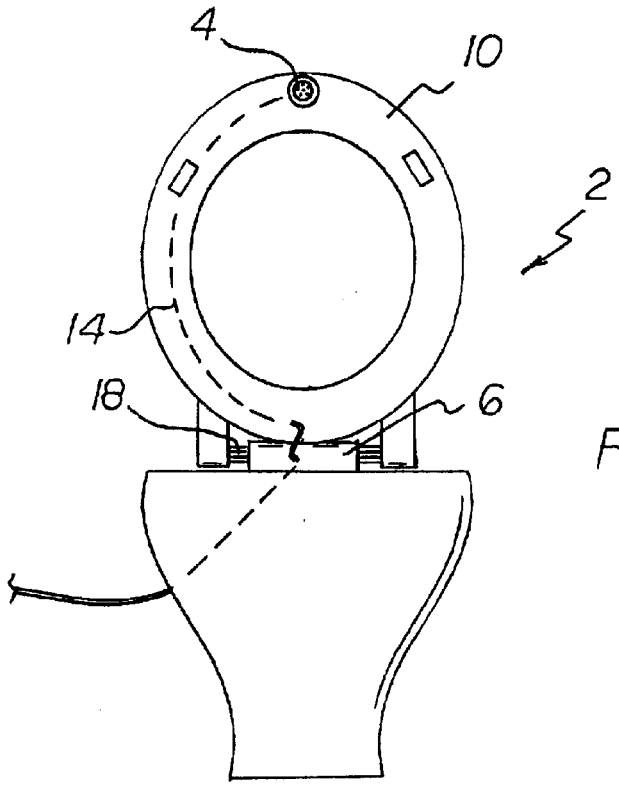
FIG 2

APPARATUS FOR LOWERING TOILET SEAT

This application claims the benefit of Provisional application Ser. No. 60/298,642, filed Jun. 18, 2001.

I. BACKGROUND OF THE INVENTION

The present invention concerns that of a new and improved apparatus for automatically lowering a toilet seat.

DESCRIPTION OF THE PRIOR ART

U.S. Pat. No. 5,794,277, issued to Jones, discloses an automatic toilet seat closing device which closes after a predetermined amount of time has past.

U.S. Pat. No. 5,488,744, issued to Paananen, discloses a device for automatically closing a toilet seat controlled by flushing the device.

U.S. Pat. No. 5,060,318, issued to Jaskiewicz, discloses a device for automatically closing a toilet seat controlled by flushing the device.

III. SUMMARY OF THE INVENTION

The present invention concerns that of a new and improved apparatus for automatically lowering a toilet seat. The apparatus includes a sensor which senses when a person has finished using a toilet, at which time, the sensor activates a motor to lower the toilet seat in a slow but steady manner. The motor is powered by power means, which could be either a battery or standard household current. Alternatively, the present invention would include a relay which would be mechanically connected to the flush handle of the toilet. When the flush handle would be used, the relay would activate the motor to lower the toilet seat in a slow but steady manner.

There has thus been outlined, rather broadly, the more important features of an apparatus for automatically lowering a toilet seat that the detailed description thereof that follows may be better understood and in order that the present contribution to the art may be better appreciated. There are, of course, additional features of the apparatus for automatically lowering a toilet seat that will be described hereinafter and which will form the subject matter of the claims appended hereto.

In this respect, before explaining at least one embodiment of the apparatus for automatically lowering a toilet seat in detail, it is to be understood that the apparatus for automatically lowering a toilet seat is not limited in its application to the details of construction and to the arrangements of the components set forth in the following description or illustrated in the drawings. The apparatus for automatically lowering a toilet seat is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present apparatus for automatically lowering a toilet seat. It is important, therefore, that the claims be regarded as including such equivalent constructions insofar as they do not depart from the spirit and scope of the present invention.

It is therefore an object of the present invention to provide an apparatus for automatically lowering a toilet seat which has all of the advantages of the prior art and none of the disadvantages.

It is another object of the present invention to provide an apparatus for automatically lowering a toilet seat which may be easily and efficiently manufactured and marketed.

It is another object of the present invention to provide an apparatus for automatically lowering a toilet seat which is of durable and reliable construction.

It is yet another object of the present invention to provide an apparatus for automatically lowering a toilet seat which is economically affordable and available for relevant purchasing market segment of the public.

Other objects, features and advantages of the present invention will become more readily apparent from the following detailed description of the preferred embodiment when considered with the attached drawings and appended claims.

IV. BRIEF DESCRIPTION OF THE DRAWINGS

FIG. 1 shows a side view of a toilet equipped with the present invention.

FIG. 2 shows a front view of a toilet equipped with the present invention.

V. DESCRIPTION OF THE PREFERRED EMBODIMENT

Figure 3:
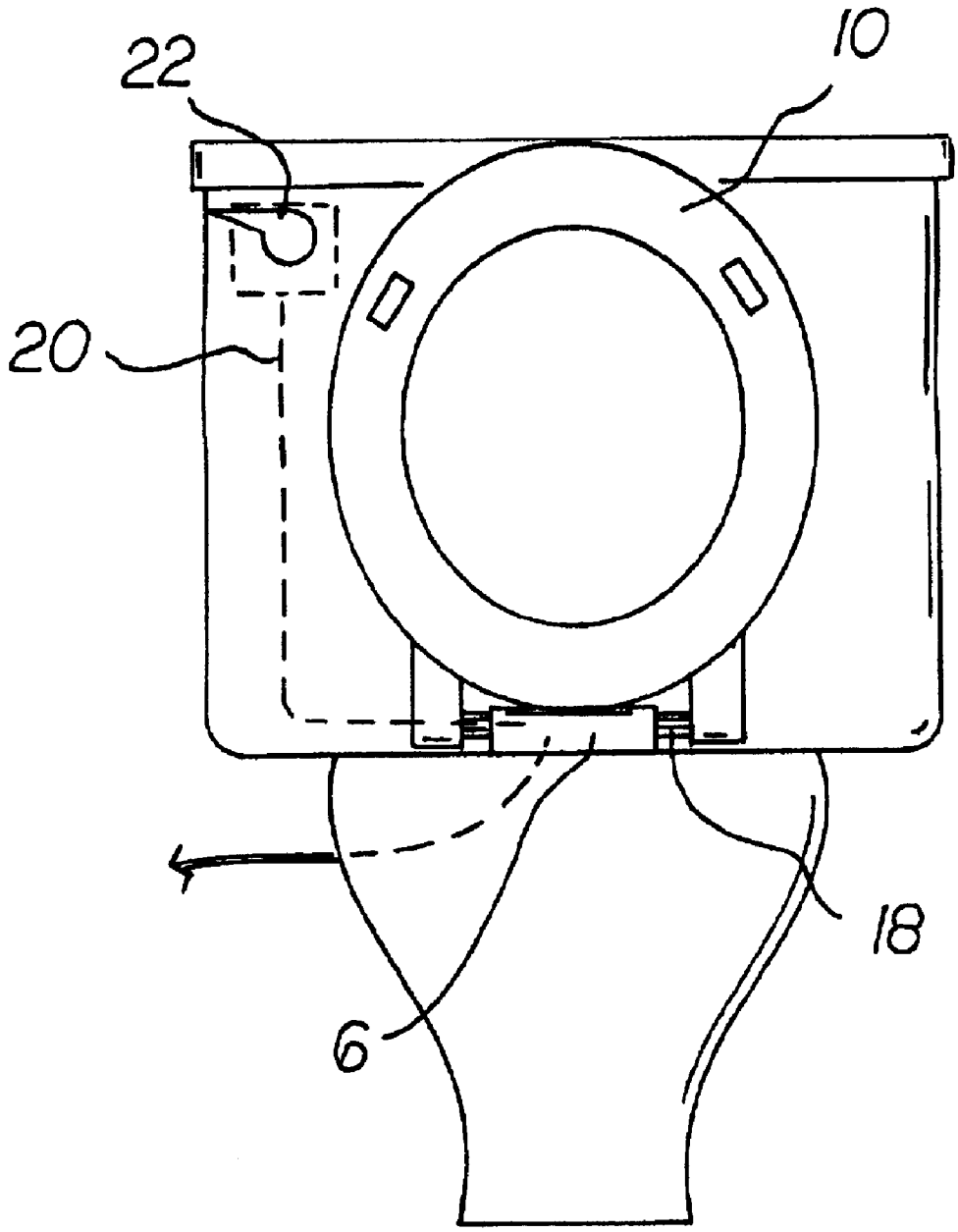
FIG. 3 shows an alternative embodiment of the present invention installed on a toilet.

Priority is hereby claimed to application 60/298,642, filed on Jun. 18, 2001.

FIGS. 1 and 2 show side and front views, respectively, of a toilet 2 equipped with the present invention. The present invention comprises at least one sensor 4, a motor 6, and power means 8. The toilet would include seat 10 and lid 12. The seat 10 and the lid 12 would normally be placed in one of two positions which would be a upright position or a lowered position.

Normally, when a user uses a toilet 2, they would put the seat 10 down after use for the next user. However, many times this does not occur, leading to many types of problems. The present invention, through a variety of mechanisms, strives to eliminate this problem by automatically lowering seat 10 down after use in case a user would forget to lower seat 10 after use of toilet 2.

Sensor 4 would preferably be located on the bottom of seat 10. In this position, as seen in FIG. 1, sensor 4 would be used to determine whether a user would be using the toilet. The sensor 4 would not actually determine if a person was using or had used the toilet, but rather, would be attempting to locate whether a person was in a position typically occupied by a person if that person were using the toilet.

Once sensor 4 senses a person in a proper position, the sensor 4 would be activated. Once the person leaves the immediate vicinity of the toilet and leaves the area typically associated with that of a person using the toilet 2, sensor 4 would provide a signal through wiring 14 to motor 6, causing motor 6 to slowly rotate seat 10 from an upward position to a lowered position. Motor 6 would be powered by power means, which would be either standard household current or a battery.

Seat 10 would be rotatably attached to toilet 2 by hinge 16. Hinge 16 would have a mechanism 18 that would allow seat 10 to be placed in an upward position freely, but at the same time, ensure that when motor 6 is lowering seat 10 from an upward to a lowered position, seat 10 does not slam down. Rather, mechanism 18 would ensure that seat 10 is lowered at a uniform and slow pace to ensure that seat 10 does not break or create a lot of noise upon being returned to its appropriate position.

FIG. 3 shows an alternative embodiment of the present invention installed on a toilet. In this embodiment, relay 20 automatically is activated after the flush handle 22 is used on toilet 2. Relay 20 would be located within the water tank of the toilet. Relay 20 mechanically and/or electronically activates motor 8, which then proceeds to lower seat 10. Seat 10 is lowered by mechanism 18, which would ensure that seat 10 is lowered at a uniform and slow pace to ensure that seat 10 does not break or create a lot of noise upon being returned to its appropriate position.

Both embodiments of the present invention would also include a switch that would be attached to the side of the toilet. The switch would be used to independently lower the lid and seat, or in the alternative, for shutting off the present invention.

What is claimed is:

1. An apparatus for automatically lowering a toilet seat, the apparatus comprising:

(a) a toilet, the toilet including a seat portion, the toilet including a flush handle and an attached water tank, (b) a toilet seat pivotally attached to the seat portion, the toilet seat having two sides, a top side and a bottom side, the toilet seat being located in one of two possible positions, an upright position and a lowered position, (c) a toilet lid pivotally attached to the seat portion, (d) a relay located within the water tank, the relay attached to the flush handle, (e) a motor attached to the top of the seat portion of the toilet, the motor connected to the toilet seat, (f) wiring to connect the relay to the motor, (g) power means for providing power to the motor and the relay, (h) wherein the relay would send a signal to the motor once the person would pull the flush handle, causing the motor to slowly rotate the toilet seat from the upright position to the lowered position.

2. An apparatus for automatically lowering a toilet seat according to claim 1 wherein the power means for providing power to the motor and the relay would comprise standard household current.

3. An apparatus for automatically lowering a toilet seat according to claim 1 wherein the power means for providing power to the motor and the relay would comprise at least one battery.

* * * * *